US010697262B2

(12) United States Patent
Gosney

(10) Patent No.: US 10,697,262 B2
(45) Date of Patent: Jun. 30, 2020

(54) SYNCHRONOUS CONTINUOUS CIRCULATION SUBASSEMBLY WITH FEEDBACK

(71) Applicant: Halliburton Energy Services, Inc., Houston, TX (US)

(72) Inventor: Jon Troy Gosney, Bellville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 516 days.

(21) Appl. No.: 14/917,803

(22) PCT Filed: Sep. 30, 2013

(86) PCT No.: PCT/US2013/062730
§ 371 (c)(1),
(2) Date: Mar. 9, 2016

(87) PCT Pub. No.: WO2015/047418
PCT Pub. Date: Apr. 2, 2015

(65) Prior Publication Data

US 2016/0222743 A1 Aug. 4, 2016

(51) Int. Cl.
*E21B 21/10* (2006.01)
*E21B 21/08* (2006.01)
*E21B 34/00* (2006.01)

(52) U.S. Cl.
CPC ..... *E21B 21/106* (2013.01); *E21B 21/08* (2013.01); *E21B 2034/002* (2013.01)

(58) Field of Classification Search
CPC ..... E21B 21/10; E21B 21/103; E21B 21/106
See application file for complete search history.

(56) References Cited

U.S. PATENT DOCUMENTS 2,158,356 A 5/1939 Dyer
3,298,385 A 1/1967 Gordon et al.
(Continued)

FOREIGN PATENT DOCUMENTS

GB 2427217 12/2006
IT 2007MI0228 8/2008
(Continued)

OTHER PUBLICATIONS

Calderoni, et al. "Managing Pressure Drilling with Continuous Circulation, A Summary of eni Experience"; SPE 147147; SPE Annual Technical Conference and Exhibition held in Denver, Colorado, Oct. 30-Nov. 2, 2011.
(Continued)

*Primary Examiner* — Robert E Fuller
*Assistant Examiner* — Lamia Quaim
(74) *Attorney, Agent, or Firm* — John W. Wustenberg; Parker Justiss, P.C.

(57) ABSTRACT

A system for continuously circulating fluid in a wellbore includes a control system comprising a memory, a power source, and a user interface, along with a drill string subassembly having an inlet and an outlet, and defining a flow path from the inlet to the outlet. The conduit includes a lateral port to the flow path between the inlet and the outlet. The drill string subassembly also as a first valve that controls flow to the flow path from the lateral port and a second valve that controls flow to the flow path from the inlet. The drill string subassembly may also include a sensor that generates a fluid coupling signal responsive to a coupling between the lateral port and secondary fluid supply source, and includes a synchronous actuation member configured open the first valve and close the second valve in response to, for example, the fluid coupling signal.

14 Claims, 10 Drawing Sheets

(56) References Cited

U.S. PATENT DOCUMENTS

| | | | | |
|---|---|---|---|---|
| 3,533,430 | A | 1/1970 | Fredd | |
| 3,559,739 | A | 2/1971 | Hutchison et al. | |
| 4,509,552 | A * | 4/1985 | Eicher | E21B 47/042 137/557 |
| 4,871,019 | A | 10/1989 | Haley et al. | |
| 6,119,772 | A | 9/2000 | Pruet | |
| 6,286,602 | B1 * | 9/2001 | Lemetayer | E21B 43/00 166/311 |
| 7,726,418 | B2 | 6/2010 | Ayling | |
| 7,845,433 | B2 | 12/2010 | Calderoni et al. | |
| 8,016,033 | B2 | 9/2011 | Iblings et al. | |
| 8,100,199 | B2 | 1/2012 | Braddick | |
| 8,151,888 | B2 | 4/2012 | Wright et al. | |
| 8,201,804 | B2 | 6/2012 | Strazhgorodskiy | |
| 2004/0159465 | A1 | 8/2004 | Ayling | |
| 2004/0159467 | A1 | 8/2004 | Ayling | |
| 2006/0060360 | A1 | 3/2006 | Moncus et al. | |
| 2006/0278434 | A1 * | 12/2006 | Calderoni | E21B 21/106 175/57 |
| 2009/0025930 | A1 | 1/2009 | Iblings et al. | |
| 2010/0025045 | A1 * | 2/2010 | Lake | E21B 34/066 166/373 |
| 2010/0096190 | A1 | 4/2010 | Younger et al. | |
| 2010/0252272 | A1 * | 10/2010 | Haughom | E21B 21/106 166/373 |
| 2010/0300543 | A1 | 12/2010 | Braddick | |
| 2011/0203670 | A1 | 8/2011 | Braddick | |
| 2011/0308860 | A1 * | 12/2011 | deBoer | E21B 17/00 175/57 |
| 2012/0073826 | A1 | 3/2012 | Miller | |
| 2014/0202767 | A1 * | 7/2014 | Feasey | E21B 21/08 175/57 |
| 2015/0252272 | A1 | 9/2015 | Chavan et al. | |

FOREIGN PATENT DOCUMENTS

| | | | |
|---|---|---|---|
| NL | 7009046 | | 12/1970 |
| NO | 20073161 | | 12/2008 |
| NO | 20074187 | | 2/2009 |
| WO | WO9816716 | A1 | 4/1998 |
| WO | WO0169034 | A2 | 9/2001 |
| WO | WO0225052 | A1 | 3/2002 |
| WO | WO2005003504 | A2 | 1/2005 |
| WO | WO2005080745 | | 9/2005 |
| WO | WO2010071656 | A1 | 6/2010 |
| WO | WO2011085031 | A2 | 7/2011 |
| WO | 2012006457 | A1 | 1/2012 |
| WO | 2013155343 | A1 | 10/2013 |

OTHER PUBLICATIONS

Calderoni, et al. Microflux Control and E-CD Continuous-Circulation Valves Allow Operator to Reach HP/HT Reservoirs for the First Time; SPE 122270; IADC/SPE Managed Pressure Drilling and Underbalanced Operations Conference & Exhibition, San Antonio, Texas, Feb. 12-13, 2009.

PCT International Search Report and Written Opinion of the International Searching Authority, PCT/US2013/062730, dated Jun. 26, 2014, 15 pages.

* cited by examiner

SYNCHRONOUS CONTINUOUS CIRCULATION SUBASSEMBLY WITH FEEDBACK

This application is a U.S. National Phase Application under 35 U.S.C. § 371 and claims the benefit of priority to International Application Serial No. PCT/US2013/062730, filed on Sep. 30, 2013, the contents of which are hereby incorporated by reference.

1. FIELD OF THE INVENTION

The present disclosure relates generally to the recovery of subterranean deposits, and more specifically to a drill string sub-assembly and associated control system that allows for continuous circulation of drilling fluid when flow from a primary fluid supply source is interrupted.

2. DESCRIPTION OF RELATED ART

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is typically attached to a drill string that may be rotated to drive the drill bit and within which drilling fluid, referred to as "drilling mud" or "mud", may be delivered downhole. The drilling mud is used to cool and lubricate the drill bit and downhole equipment and, as such, is circulated through the drill string and back to the surface in an annulus formed by the space between the drill string and wall of the well bore.

The drilling mud may also be used to accomplish other functions, such as transporting any rock fragments or other cuttings from the drill bit to the surface of the well, pressurizing the wellbore to prevent the wellbore from degrading or collapsing, and providing kinetic energy to other downhole equipment.

DETAILED DESCRIPTION OF ILLUSTRATIVE EMBODIMENTS

Figure 1:
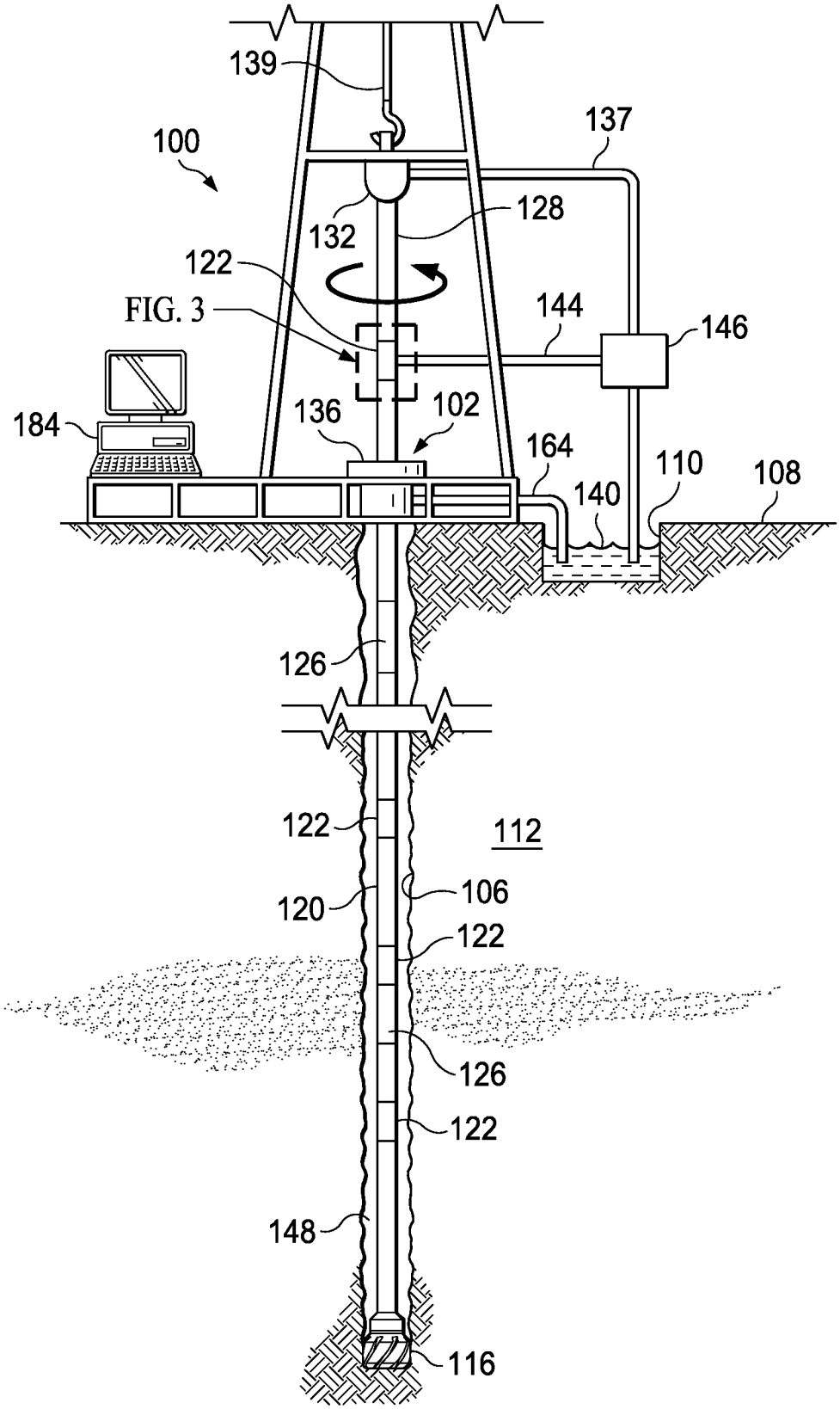
FIG. 1 is a schematic, front view of a well that includes a system for continuously circulating fluid in a drill string during an interruption of fluid supply from a primary fluid supply source.

In the following detailed description of the illustrative embodiments, reference is made to the accompanying drawings that form a part hereof. These embodiments are described in sufficient detail to enable those skilled in the art to practice the invention. It is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Many elements in a drill string include hydraulic, mechanical, or electrical components that assist with the operation of the drill string or collect logging-while-drilling (LWD) or measurement-while-drilling (MWD) data related to the operation of the drill string and properties of the wellbore. Collectively, these components, along with other subassemblies or segments of the drill string, may be referred to as drill string elements. In operation, the drill string elements may operate more consistently and be less likely to suffer damage if they are protected from rapid fluctuations in pressure within the wellbore. Rapid fluctuations in fluid pressure may result in "kick" or other pressure spikes that may negatively impact the operation of the drill string elements and the integrity of the well.

One potential cause of rapid pressure fluctuation is the starting and stopping of fluid (e.g., drilling mud, or drilling fluid) circulation in the wellbore. Yet in a system in which fluid is circulated into the drill string via the topmost element in the drill string, it may be necessary to stop fluid flow when changing out a drill string element or adding or removing drill string elements from the drill string. To avoid the unwanted pressure variations in the drill string and other problems that result from stopping and re-starting the pumps and other systems used to circulate fluid through the wellbore, the systems, methods, and subassemblies described herein provide for continuous circulation of drilling fluid through the drill string and wellbore even when a drill string element is added to or removed from the drill string. The illustrated systems, methods, and subassemblies may be in the form of a drill string subassembly that is, in some embodiments, used in combination with other subsystems. In an embodiment, the drill string subassembly may include a feedback mechanism and synchronous valve system. The synchronous valve system includes an inlet valve, which may be located at or near the inlet of the subassembly and may be referred to as a second valve in view of the lateral valve discussed below. In normal operation, the inlet valve is in an open position to allow flow into the drill string subassembly from a primary fluid supply source. The synchronous valve system also includes a lateral valve, which may also be referred to as a first valve, and which may be located in a lateral port. The lateral valve is closed during normal drilling operations to restrict flow through the lateral port. When a connection is to be made to the drilling string, a hose may be connected to the lateral port to supply fluid to the drill string from a secondary fluid supply source. This enables segments to be added to or removed from the drill string upstream from the drill string subassembly without interrupting the flow of fluid to the downstream wellbore.

In an embodiment, a two-stage, synchronized valve system that includes one or more feedback sensors may be implemented to ensure that the hose is connected and sealed to the drill string subassembly and to activate the synchronized valve system by starting flow through the hose. The synchronous valve system may be actuated using a hydraulic, mechanical, pneumatic, or electronic synchronous actuation member, which may also include feedback notification. For example, the valve may be hydraulically actuated by mud flow from the secondary fluid supply source through the lateral port.

Figure 2:
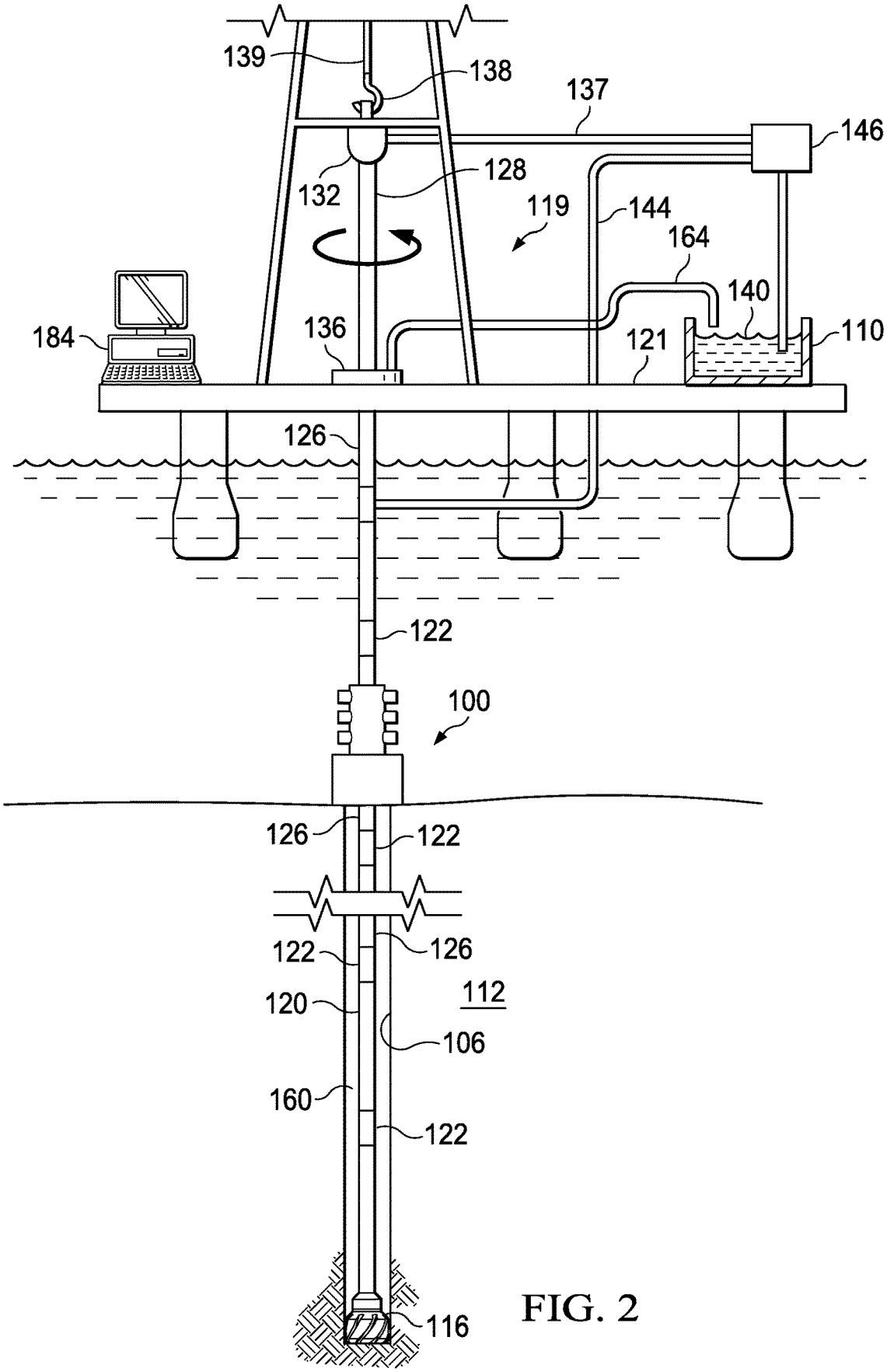
FIG. 2 is a schematic, front view of a subsea well that includes the system for continuously circulating fluid in a drill string during an interruption of fluid supply from a primary fluid supply source.

Referring now to the figures, FIG. 1 shows a continuous circulation system 100 that includes a subassembly 122 for providing continuous circulation of fluid and an associated control system that may include mechanical, hydraulic, or electrical controls. The subassembly 122 and associated control system are used in a well 102 having a wellbore 106 that extends from a surface 108 of the well 102 to or through a subterranean formation 112. The well 102 is illustrated onshore in FIG. 1 with the subassembly 122 being deployed at multiple locations within a drill string 120 to facilitate multiple connection points to the drill string 120. In another embodiment, the subassembly 122 and associated control system may be deployed in a sub-sea well 119 accessed by a fixed or floating platform 121, as shown in FIG. 2. FIGS. 1 and 2 each illustrate possible implementations of the subassembly 122, and while the following description of the subassembly 122 and associated control system focusses primarily on the use of the subassembly 122 and related control system with the onshore well 102 of FIG. 1, the subassembly 122 and control system may be used instead in the well configuration illustrated in FIG. 2, as well as in other well configurations where it is desirable to provide continuous circulation to a tool string and wellbore 106 when fluid input from a primary fluid source is interrupted. Similar components in FIGS. 1 and 2 are identified with similar reference numerals.

The well 102 is formed by a drilling process in which a drill bit 116 is turned by the drill string 120 to remove material from the formation and form the wellbore 106. The drill string 120 extends from the drill bit 116 at the bottom of the wellbore 106 to the surface 108 of the well 102, where it is joined with a kelly 128. The drill string 120 may be made up of one or more connected tubes or pipes of varying or similar cross-section. The drill string 120 may refer to the collection of pipes or tubes as a single component, or alternatively to the individual pipes or tubes that comprise the string. The term drill string is not meant to be limiting in nature and may refer to any component or components that are capable of transferring rotational energy from the surface of the well to the drill bit 116. In several embodiments, the drill string 120 may include a central passage disposed longitudinally in the drill string 120 and capable of allowing fluid communication between the surface 108 of the well and downhole locations.

At or near the surface 108 of the well 102, the drill string 120 may include or be coupled to the kelly 128. The kelly 128 may have a square, hexagonal or octagonal cross-section. The kelly 128 is connected at one end to the remainder of the drill string 120 and at an opposite end to a rotary swivel 132. The kelly passes through a rotary table 136 that is capable of rotating the kelly 128 and thus the remainder of the drill string 120 and drill bit 116. The rotary swivel 132 allows the kelly 128 to rotate without rotational motion being imparted to the rotary cable 139. A hook 138, the cable 139, a traveling block (not shown), and a hoist (not shown) are provided to lift or lower the drill bit 116, drill string 120, kelly 128 and rotary swivel 132. The drill string 120 may be raised or lowered as needed to add additional sections of tubing to the drill string 120 as the drill bit 116 advances, or to remove sections of tubing 126 from the drill string 120 if removal of the drill string 120 and drill bit 116 from the well 102 are not desired. While the rotary table 136 and kelly 128 are described herein as providing the rotational force to turn the drill string 120, other systems may be used in their place. For example, a top drive assembly having a motor that turns the drill string 120 may be used to form the wellbore 106.

The subassembly 122 may be included between segments 126 of the drill string 120 to allow upstream or "up-string" components to be added to or removed from the drill string 120 without the interruption of fluid supply to the downhole portion of the drill string 120. While the embodiment described below is primarily discussed as a subassembly, it is noted that the features of the subassembly may also be incorporated into a drill pipe, for example. In such an embodiment, the subassembly 122 may be viewed as a portion of the drill pipe rather than a distinct subassembly. As shown in FIG. 1, in normal operation, drilling fluid 140 is stored in a drilling fluid reservoir 110 and pumped into an inlet conduit 137 using a pump 146, or plurality of pumps disposed along the inlet conduit 137. Drilling fluid 140 passes through the inlet conduit 137 and into the drill string 120 via a fluid coupling at the rotary swivel 132. The drilling fluid 140 is circulated into the drill string 120 to maintain pressure in the drill string 120 and wellbore 106 and to lubricate the drill bit 116 as it cuts material from the formation 112 to deepen or enlarge the wellbore 106. After exiting the drill string 120, the drilling fluid 140 carries cuttings from the drill bit back to the surface 108 through an annulus 148 formed by the space between the inner wall of the wellbore 106 and outer wall of the drill string 120. At the surface 108, the drilling fluid 140 exits the annulus and is carried to a repository. Where the drilling fluid 140 is recirculated through the drill string 120, the drilling fluid 140 may return to the drilling fluid reservoir 110 via an outlet conduit 164 that couples the annulus 148 to the drilling fluid reservoir 110. The path that the drilling fluid 140 follows from the reservoir 110, into and out of the drill string 120, through the annulus 148, and to the repository may be referred to as the fluid flow path.

At various times during the formation of the well 102, it may be desirable to add or remove segments 126 to or from the drill string 120. However, for the reasons noted above, it may be undesirable to stop the flow of fluid into the drill string 120. As such, the subassembly 122 and associated control system, which may be a mechanical control system, provide for the continued circulation of drilling fluid 140 through the drill string 120 even when flow from a primary source of the drilling fluid 140 is suspended. As described in more detail below with regard to FIGS. 3 and 4, the subassembly 122 provides for the connection of a secondary fluid supply source 170, which may be an alternate fluid inlet similar to the fluid inlet 137 that provides fluid flow from the reservoir 110 to an intermediate location within the drill string 120 that corresponds to a subassembly location that is upstream from the segment 126 to be added or removed. The subassembly 122 is communicatively coupled via a wired or wireless communications interface to a surface controller 184, which provides for feedback functionality and verification that the secondary fluid supply source 170 is properly coupled to the subassembly 122 to supply fluid to the drill string 120 before terminating flow from the primary fluid supply source. The surface controller 184 may be a personal computer operated by an operator, a personal computing device, such as a tablet, laptop, slate, or other mobile computing device of an operator, or any other suitable computing device.

Figure 3:
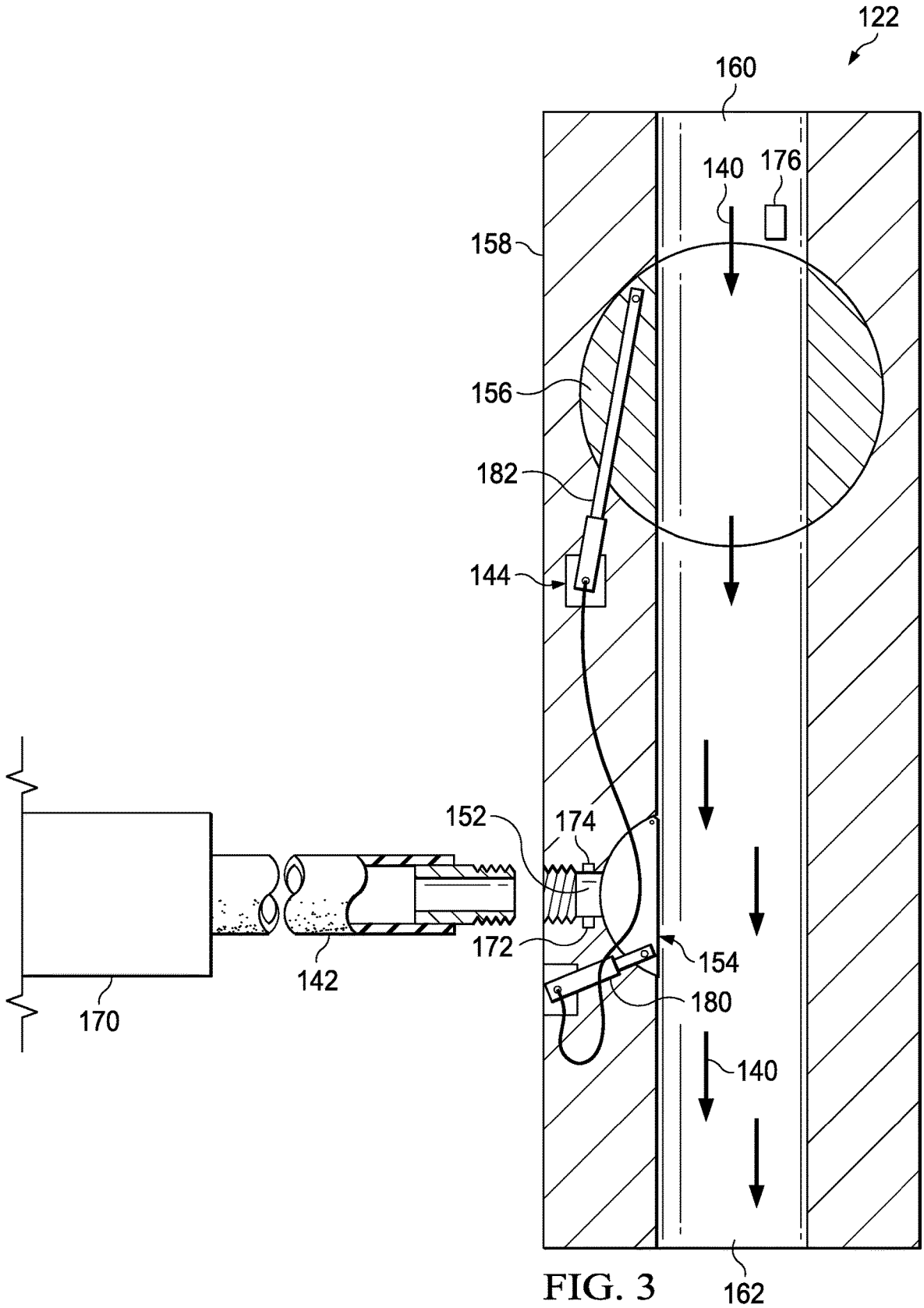
FIG. 3 is a detail view showing a subassembly used in the systems of FIGS. 1 and 2 to enable a portion of the drill string to receive fluid from a secondary fluid supply source, wherein the subassembly is in a first operating state in which fluid is received from the primary fluid supply source.
Figure 4:
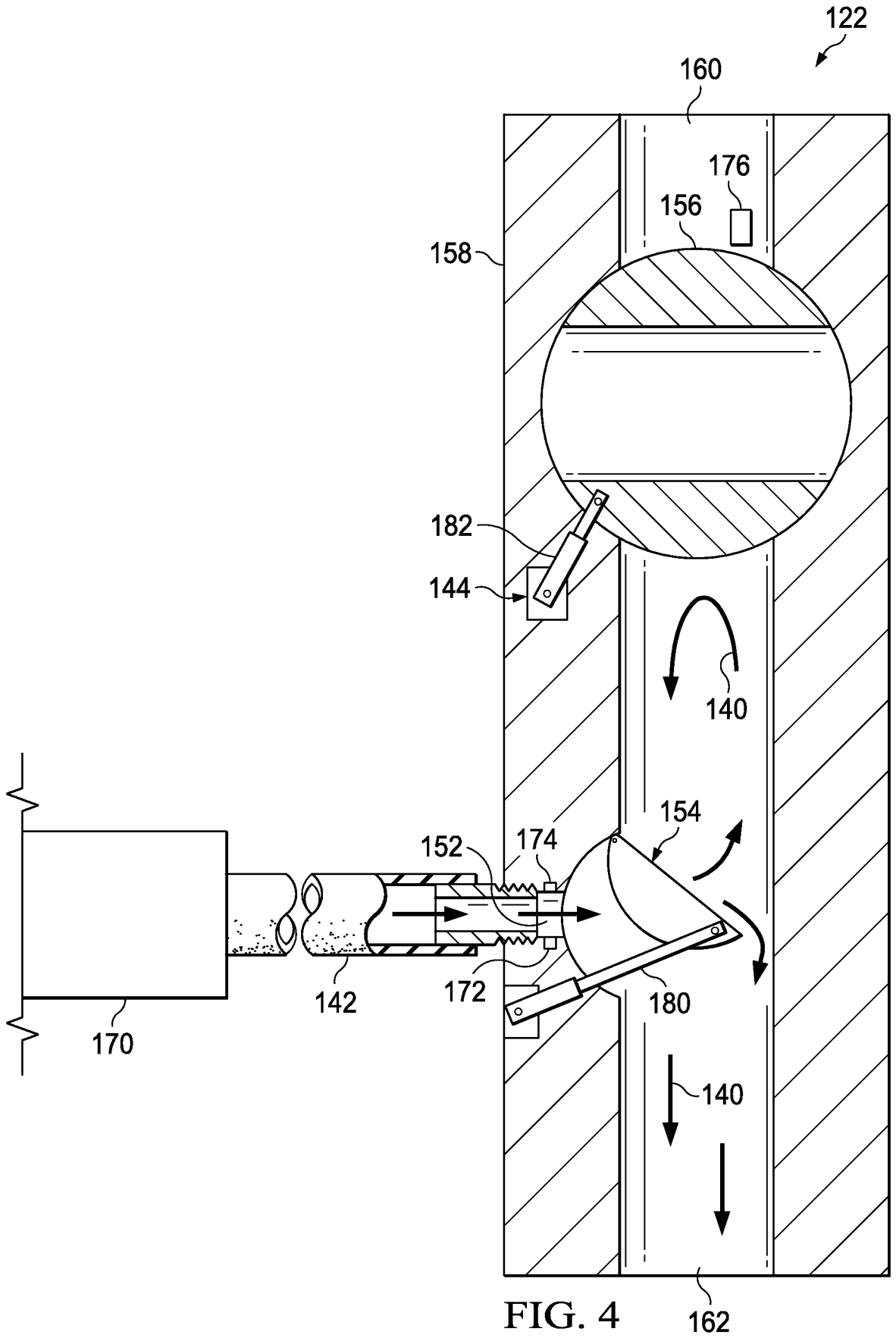
FIG. 4 is a detail view showing the subassembly of FIG. 3 in a second operating state in which fluid is received from the secondary fluid supply source via a lateral port.

Referring now to FIGS. 3 and 4, an illustrative embodiment of the subassembly 122 is shown in a disconnected and connected state, respectively. The subassembly 122 includes a conduit 158, which may be a pipe segment or other tubular structure, having an inlet 160 and outlet 162. When the subassembly 122 is installed within an operational drill string 120, drilling fluid flows along a fluid flow path from the inlet 160 through an inlet valve 156 at or near the inlet 160, which may be referred to as a second valve, through the conduit 158, and out of the outlet 162 to downstream elements within the drill string 120. The subassembly 122 also includes a lateral port 152 having a lateral valve 154, which may be referred to as a first valve, that regulates fluid flow through the lateral port 152 by allowing fluid flow into the conduit 158 when open and preventing fluid flow into the conduit when closed.

The lateral port 152 may include a threaded surface and keyed opening that complement a corresponding key and threaded surface on, for example, the connecting end of a hose 142 that is coupled to the secondary fluid supply source. In such an embodiment, engagement of the key and keyed opening may result from the threads being fully engaged or approximately fully engaged or from deliberate user operation of the key. Engagement of the key and keyed opening may cause the lateral valve 154 to open and the inlet valve 156 to close, or may trigger a sensor at the lateral port 152 or in the hose 142 to indicate that the hose 142 is fluidly coupled to the lateral port 152. Such a sensor may be referred to as a fluid coupling sensor. In an embodiment, such a key may be manually engaged after an operator determines that a secure seal has been formed at the threaded surface to open or close the valves 154 and 156. In such an embodiment, a turn or partial turn, such as a quarter turn or half-turn, of the key may cause the key to engage a synchronous actuation member 144 to operate the valves 154 and 156.

In an additional embodiment, the conduit 158 may be formed with an additional side port that provides access to the synchronous actuator using a key, such as a hex-type key, Allen wrench, or a handle that is temporarily assembled to the valve 154 for operation. In such an embodiment, an operator may insert and rotate the key to actuate the valves 154, 156 after connecting the hose 142 and initiating flow from the secondary fluid supply source 170.

Between the inlet 160 and the lateral port 152, the subassembly 120 includes the inlet valve 156, which permits fluid flow from the inlet 160 to the outlet 162 when open and restricts fluid flow from the inlet 160 to the outlet 162 when closed. The subassembly 120 further includes the synchronous actuation member 144, which is coupled to the inlet valve 156 and lateral valve 154 for the purpose of synchronizing the actuation of the valves 154, 156.

In general, subassembly 122 has two primary operating states. In the first primary operating state, the subassembly 122 receives fluid from the primary fluid supply source, and fluid 140 flows from the inlet 160 to the outlet 162 through the open inlet valve 156 and past the closed lateral valve 154. In the second primary operating state, the subassembly receives fluid from a secondary fluid supply source 170, and the fluid 140 flows into the lateral port 152 through the open lateral valve 154 and out of the outlet 162 while fluid is prevented from entering or exiting the subassembly 122 from the inlet 160 by the closed inlet valve 156. As such, the lateral valve 154 is generally open when the inlet valve 156 is closed, and the inlet valve 156 is generally open when the lateral valve 154 is closed. This condition is maintained by the synchronous actuation member 144, which is coupled to the lateral valve 154 and inlet valve 156. The lateral valve 154 and inlet valve 156 each may be any suitable valve. For example, each valve may be a ball valve, flapper valve, a unidirectional plunger valve, a throttle valve, or a butterfly valve.

In an embodiment, the valves 154, 156 may be computer controlled, full-bore ball valves that can be repeatedly opened and closed by remote command. Such valves 154, 156 may include a control system and battery, and may include integrated pressure and temperature sensors. A controller of the valves 154, 156 may be programmed to open or close the valves 154, 156 when a certain condition, or "trigger" is detected. The trigger may include a variety of conditions at or near the inlet valve 156 or lateral valve 154, and each trigger condition may cause the valves 154, 156 to open or close in accordance with preprogrammed instructions. For example, by applying a defined pressure to the wellbore for a defined time at surface, the operator can activate the trigger, thereby allowing direct communication to the valves 154, 156 so that they can be remotely operated. For example, applying pressure pulses or applying a static pressure of between 1,000-1,500 psi for a user-defined time period, which may be instantaneous or a prolonged time period, could instruct the inlet valve 156 to open and lateral valve 154 to close. The inlet valves 154, 156 may also be programmed to operate autonomously in response to a range of triggers or a combination of triggers, such as ambient pressure, pressure pulses, ambient temperature and timing. Another such trigger may be the receipt of feedback from a fluid coupling sensor that indicates a secure connection has been made between the hose 142 and lateral port 152 to ensure that only the valves of the topmost subassembly 122 are actuated when a secondary fluid supply source is connected. Additionally, to ensure that the hose 142 is secured to the subassembly 122, the hose 142 may be secured to the subassembly using a strap that is formed integrally with the hose. In such an embodiment, the hose may be formed to include a clamping structure such as a clamping structure resembling a modified Parmelee wrench, a hose clamp, or a similar device.

In an embodiment, each of the valves 154, 156 may be a well tubing valve that is rotationally movable relative to the subassembly 122 to align or misalign valve apertures with the flow paths through the inlet port 160 and lateral port 152.

The valves 154, 156 may be operable to rotate in only a single direction in response to an electronic or hydraulic control signal conveyed by one or more control lines, which may be electronic or hydraulic control lines. In such an embodiment, the valves 154, 156 may be synchronously or independently rotated using pressure pulses or electronic signals to rotate the valves 154, 156 between open positions, closed positions, and intermediate positions, or in the case of a lateral valve 154, between positions that allow inlet flow from a primary flow path from the inlet port 160 and a lateral flow path from the lateral port 152, and intermediate positions. Providing a valve member that rotates in only one direction (a "unidirectional" valve) facilitates the actuation of multiple valves from a single control line that acts in the same direction, eliminating the need for a double-acting actuator or reverse direction flow, and a corresponding hydraulic return line. Using such a common control line, each of the valves 154, 156 may be actuable to at least three operating positions to incrementally adjust flow through the respective port, thereby enabling many secondary operating states in which one or both of the valves 154, 156 are partially open. As such, the common control line may convey a single pressure pulse from the surface to cause the valve members to move to one of the three operating positions. As noted above, the positions may be open, closed or at an incremental value therebetween.

In an embodiment, the surface controller 184 or a mechanical or hydraulic control system may control the transition of the valves 154, 156 such that the valves gradually transition from the open and closed positions. Such gradual operation may allow an operator to gradually start and stop flow from the primary fluid supply source and secondary fluid supply source, which may help to ensure that sudden increases in pressure are not experienced by pump systems that deliver fluid from the primary fluid supply source and secondary fluid supply source to the drill string.

Referring now to FIGS. 3 and 4, the synchronous actuation member 144 described above is shown in as a subsystem that includes a controller, which is electrically coupled to a first solenoid 180 that actuates the lateral valve 154 and a second solenoid 182 that actuates the inlet valve 156. In another embodiment, a single solenoid may be used to actuate both of the valves 154 and 156. In the embodiment of FIG. 3, the synchronous actuation member includes solenoids 180 and 182, or a single solenoid, which are arranged to open and close the lateral valve 154 and inlet valve 156, respectively, upon receiving an electronic signal from the controller. In another embodiment, the synchronous actuation member 144 may be a mechanical actuator that is coupled to each of the valves 154, 156, such as a series of gears, a mechanical actuator or linkage, a cable, or a chain. In addition, the synchronous actuator member may be a single or dual electronic actuator, a traveling nut actuator, a worm gear actuator, a cylinder actuator, or an electric motor actuator. The synchronous actuator member may also be any combination of the types of actuators referenced herein.

In another embodiment, the synchronous actuation member 144 may include one or more hydraulic or pneumatic solenoids, analogous to the electronic solenoids 180, 182 of FIG. 3, but actuated by pressure pulses in place of an electronic control signal. In another embodiment, the synchronous actuation member 144 may include a hydraulic control line coupled to rotational valves 154, 156 actuated by pressure pulses. In another embodiment, the synchronous actuation member may be actuated via a side port, which may be a second lateral port, to mechanically, hydraulically, electrically, or pneumatically trigger the synchronous actuation of the valves 154, 156. For example, such actuation may include an operator manually engaging and turning one of the valves 154 or 156, thereby engaging a worm gear or mechanical linkage coupled to the other valve 156 or 154 to synchronously operate the valves 154, 156. In another exemplary embodiment, the side port may provide access to a hydraulic, electric, or pneumatic control line that operates the synchronous actuation member 144. Like the lateral port 152, the side port may be covered with a plug when not in use.

In an embodiment, the synchronous actuation member 144 includes an electronic control system that is operable to receive an electronic signal instructing the synchronous actuation member 144 actuate solenoids or other motorized elements that open and close the valves 154, 156. In another embodiment, the synchronous actuation member 144 includes a mechanical linkage that causes the valves to synchronously open and close. In an embodiment in which the synchronous actuation member 144 comprises electronics, it may be necessary to supply the synchronous actuation member 144 with electric power. If needed, electric power may be supplied to the synchronous actuation member 144 from a battery that is included within the subassembly 122, by an umbilical cable included within the drill string, by an umbilical cable included within the hose 142, or by circuit elements embedded within the hose 142 that couple to the subassembly 122 upon engagement of the hose 142 with the lateral port 152. Such embedded circuit elements may include conductive traces that align with conductive traces in the body of the subassembly 122 when the hose 142 of an associated key is engaged.

In an illustrative embodiment, the lateral port 152 is sized and configured to receive and couple with a fitting of a hose 142 that is fluidly coupled to the secondary fluid supply source 170. The fitting may be a pipe threading, or any other type of sealable coupling that provides a fluid seal between the hose 142 and lateral port 152. As such, the lateral port 152 includes a mating surface that complements the fitting of the hose 142 to complete the sealable coupling. In an embodiment, the subassembly 122 may also include a plug (not shown) to occupy the lateral port 152 and prevent the ingress of mud or debris into the lateral port 152 or surfaces thereof when the subassembly 122 is submerged in the wellbore. In addition to the plug, a pin or set screw may be inserted through the plug or conduit 158 or to prevent the valves 154 and 156 from being inadvertently actuated when no hose is coupled to the lateral port 152. In an embodiment, the lateral port 152 may also include a spring mounted inside of the lateral port 152 to maintain tension against the hose 142 or a plug that is threaded into the lateral port 152 to prevent the hose 142 or plug from loosening.

In an embodiment, the lateral port 152 also includes a fluid coupling sensor 172, which may be a contact sensor, strain gauge, or other suitable sensor that is operable to determine that a sealed fluid coupling has been formed between the hose 142 and lateral port 152 when the secondary fluid supply source 170 is coupled to the lateral port 152. The fluid coupling sensor may also be used to determine that a fluid seal has been formed between a plug and the lateral port 152 when the secondary supply fluid source 170 is not coupled to the lateral port 152. The fluid coupling sensor 172 may be integrated into the lateral port 152 or, in another embodiment, may be integrated into the hose 142 or plug. As such, the fluid coupling sensor may be operable to communicate to the controller whether a plug or hose 142 is coupled to the lateral port 152. In addition, sensors may be included at the lateral valve 154 and 156 to indicate, in the case of each valve, whether the valves 154 and 156 are in an open, closed, or intermediate state. In an embodiment in which the fluid coupling sensor 172 is coupled to a controller, the fluid coupling sensor 172 may be used to provide an operator with information that indicates whether the lateral port 152 is sealed, and whether it is sealed to either a plug or hose 142. The fluid coupling sensor 172 may be coupled to the controller via a direct wired communicative coupling or to a surface controller 184 using a wireless communicative coupling or a wired communicative coupling in the form of an umbilical cable fastened to the drill string or included or integrated within the hose 142.

In an embodiment, the fluid coupling sensor may include a near field communications device. For example, a radio-frequency identification ("RFID") tag or RuBee tag may be included in the lateral port 152, and the tag may be identified by a corresponding reader included within the hose 142. The tag and reader may be positioned and configured, in terms of location and power level, such that the reader will not detect the tag unless hose 142 has fully engaged the lateral port 152. A near field fluid coupling sensor and reader may also be configured such that the reader is in the subassembly 122 and the tag is in the hose 142. Tags and readers may also be included in plugs to be included in the lateral port or inlet, in the subassembly, in an umbilical cable that is included in the drill string 120 or hose 142, and in other drill string elements so that a fluid coupling sensor may also be used to determine whether a hose 142 is coupled to the lateral port 152, whether a plug is fluidly coupled to seal the lateral port or inlet, or whether a drill sting element is connected to or disconnected from the subassembly 122.

In an embodiment, the lateral port 152 may also include a fluid sensor 174, which detects properties of fluid flowing through the lateral port 152. As such, the fluid sensor 174 may be a pressure sensor, a flow sensor, another suitable type of sensor, or a combination thereof. In an embodiment in which the fluid sensor 174 is a flow sensor, the fluid sensor 174 generates a flow signal in response to detecting fluid flow in the lateral port 152. The flow signal may also be indicative of the rate of fluid flow through the lateral port 152, and may be located in the hose 142 or lateral port 152. In an embodiment in which the fluid sensor 174 is a pressure sensor, the fluid sensor 174 generates a pressure signal indicative of the pressure of fluid occupying the lateral port 152. The synchronous actuation member 144 may include an onboard controller and be coupled to the fluid sensor 174 to receive signals generated by the fluid sensor 174. In another embodiment, the fluid sensor 174 and synchronous actuation member 144 may be communicatively coupled to the surface controller 184, which may generate commands to the synchronous actuation member 144 based on signals received from the fluid sensor 174.

In an embodiment, the subassembly 122 also includes a second fluid sensor 176 which, like the fluid sensor 174 may be a pressure sensor, a flow sensor, another suitable type of sensor, or a combination thereof. The second fluid sensor 176 is located at or near the inlet 160, and may be located between the inlet 160 of the conduit 158 and the inlet valve 156. The second fluid sensor 176 may be operable to generate a signal indicative of properties of the fluid in the conduit 158 upstream of the inlet valve 156. For example, the second fluid sensor 176 may generate a signal that is indicative of the pressure or flow rate of the fluid in the conduit 158 upstream of the inlet valve 156. The second fluid sensor 176 may also be communicatively coupled to the synchronous actuation member 144 and the surface controller 184.

In an embodiment, multiple subassemblies 122 may be included as optional breakpoints, or fluid supply points, in a comprehensive system to provide for continuous circulation of fluid in the wellbore when a drill string element is added to or removed from the drill string. For example, the subassemblies 122 may be included at regular intervals so that when an operator desires to add or remove elements from the drill string 120, only a portion of the drill string that is no longer than the interval is retracted from the wellbore 106 to add or remove the drill string element. The comprehensive system includes a controller, such as the surface controller 184, which in turn includes a memory, a power source, and a user interface. The controller is communicatively coupled to sensors, such as the first fluid sensor 174 and second fluid sensor 176, and fluid coupling sensor 172 by wired or wireless transceivers included in the subassemblies 122 and the controller. The controller is similarly coupled to the synchronous actuation member 144 which, in turn is coupled to the inlet valve 156 and lateral valve 154 and is thereby operable to synchronously open and close the valves 154, 156 in response to receiving a command from the controller or in response to receiving a signal from a sensor within the subassembly 122.

Figure 5:
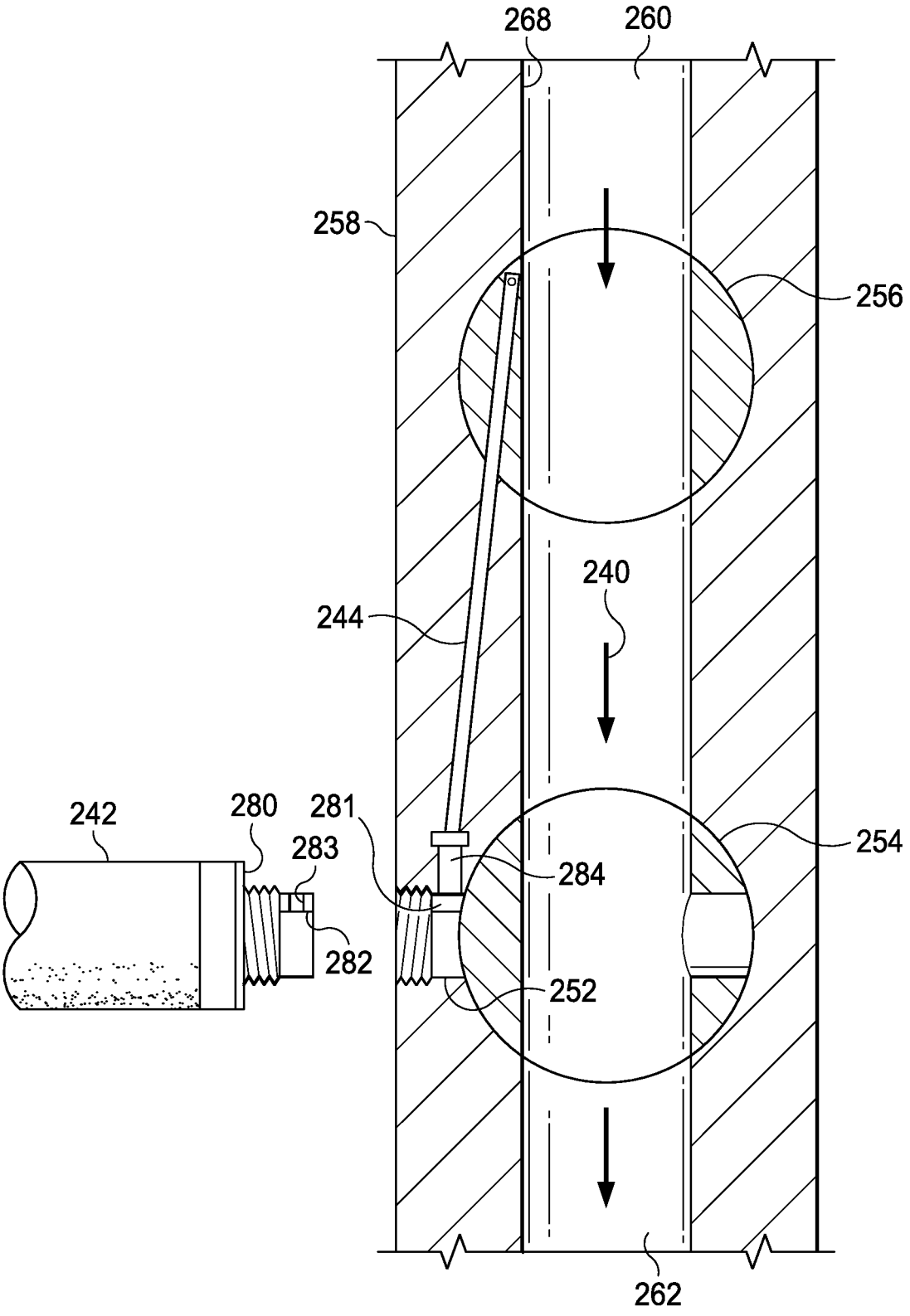
FIG. 5 is a detail view showing an alternative embodiment to the subassembly of FIGS. 3 and 4, wherein the subassembly is in a first operating state in which fluid is received from a primary fluid supply source.
Figure 6:
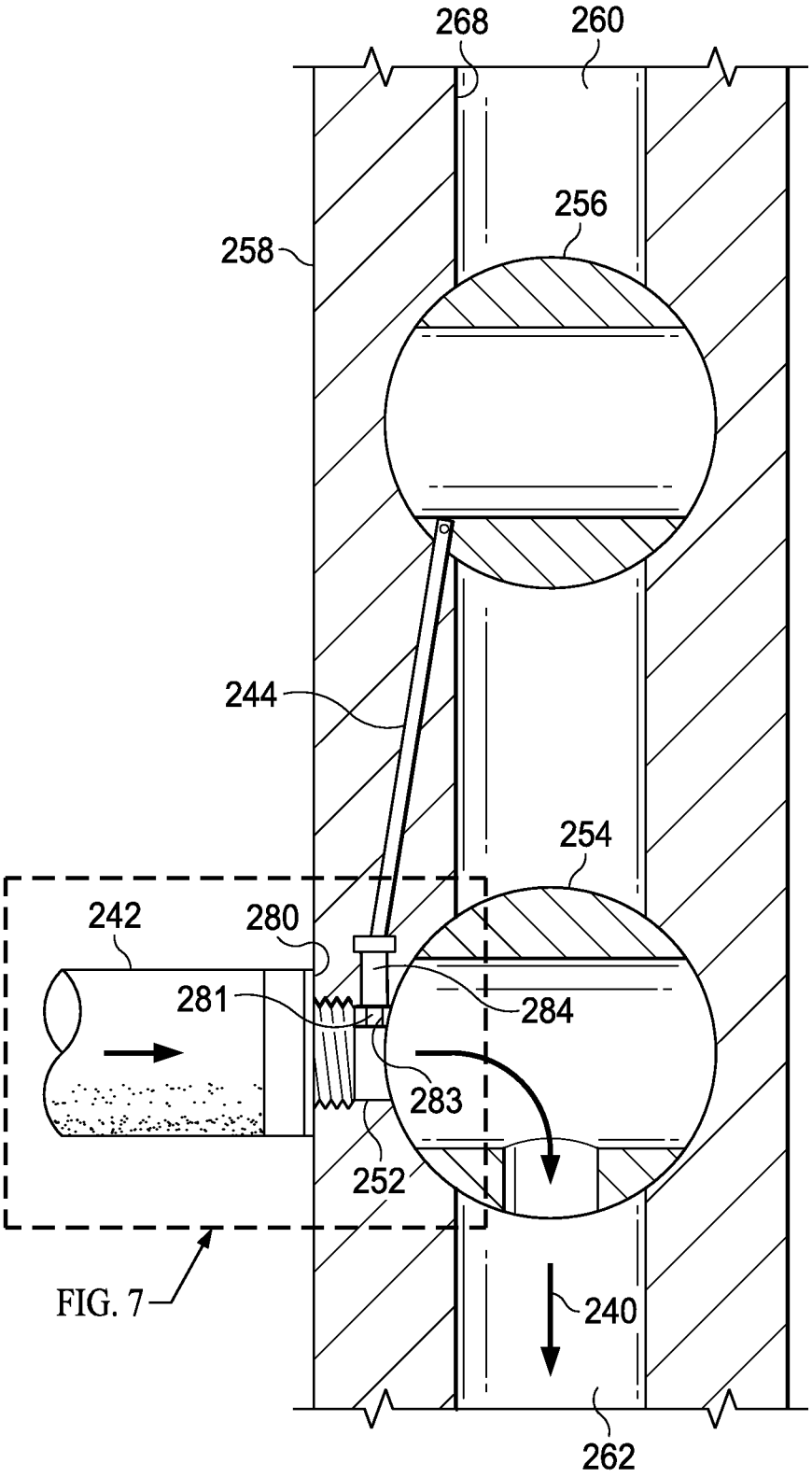
FIG. 6 is a detail view showing the subassembly of FIG. 5, wherein the subassembly is in a second operating state in which fluid is received from a secondary fluid supply source.

FIGS. 5 and 6 show an alternative embodiment of a subassembly 222 that provides for continuous circulation of fluid to a drill string by accepting fluid from a secondary fluid supply source when flow from a primary fluid supply source is interrupted. The subassembly includes a conduit 258, which may be a segment of drill pipe, an inlet 260, an outlet 262, and forms a fluid flow path between the inlet 260 and outlet 262. Similar to the subassembly 122 described above, the subassembly 222 includes a first valve, which is a lateral valve 254. In the embodiment of FIGS. 5 and 6, the lateral valve is a quarter-turn valve that is configured for controlling fluid flow into the conduit 258 from the lateral port 252 of the conduit 258. The subassembly 222 also includes a second valve, which is an inlet valve 256 for controlling flow through the inlet 260 of the conduit 258. The inlet valve 256 may also be a quarter-turn ball valve. The subassembly further includes a synchronous actuation member 244 coupled to the first and second valves 254, 256, which is configured to synchronize the operation of the first valve 254 and second valve 256. As noted above, each of the valves 254, 256 may be any suitable valve type, such as a flapper valve, ball valve, or butterfly valve.

In the embodiment of FIGS. 5 and 6, the lateral valve 254 is located adjacent a lateral port 252 that is configured to receive fluid from a secondary fluid supply source. Fluid from the secondary fluid supply source may be received from a hose 242, which is shown de-coupled from the lateral port 252 in FIG. 5 and coupled to the lateral port 252 in FIG. 6. In a first operating state, as shown in FIG. 5, fluid 240 enters the conduit 258 via the inlet 260, flows through the open inlet valve 256 and lateral valve 254, and out of the outlet 262 to downstream drill string elements. In a second operating state, as shown in FIG. 6, the inlet valve 256 is closed to seal and restrict flow into the inlet 260. In the second operating state, fluid 240 is received from a secondary fluid supply source via the hose 242, which is coupled to the lateral valve 252. Fluid 240 flows into the lateral valve 254, which is toggled to restrict flow toward the inlet 260 while allowing the fluid 240 to flow to the outlet 262 and downstream elements of the drill string.

Figure 7:
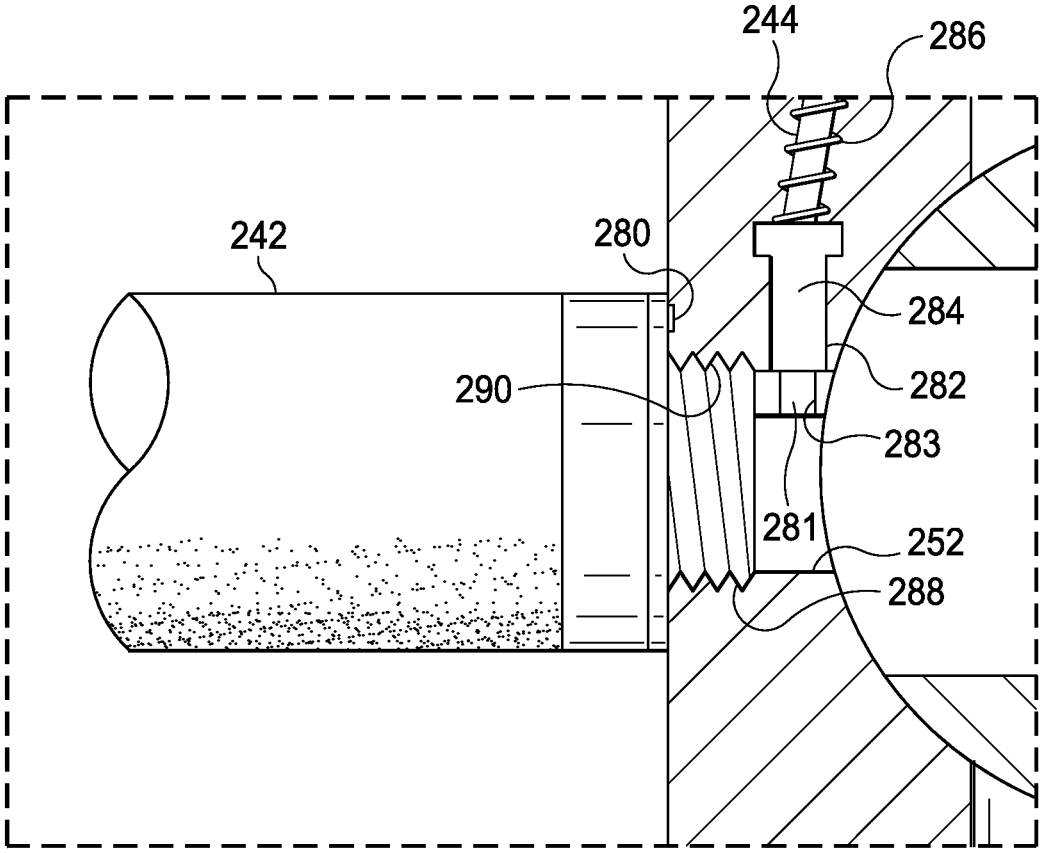
FIG. 7 is a detail view showing a portion of the subassembly of FIGS. 5 and 6 that includes a keyed lateral port.

FIG. 7 shows a detail view of the interface between the lateral port 252 and hose 242. In the embodiment, the lateral port includes a first threaded surface 288 that is configured to complement a second threaded surface 290 on the hose 242. Further, the lateral port 252 includes an actuator port 284, which is a fluid path for receiving hydraulic fluid to actuate the synchronous actuator member 244 and, in turn, the valves 254, 256 when sufficient pressure or flow is present. The synchronous actuator member 244 may be a hydraulic actuator that is activated by fluid received via the actuator port, and may function by delivering a pressure pulse, actuating a hydraulic piston that applies a force that is translated to open the valves 254, 256, or by actuating one or more hydraulic solenoids. In the embodiment of FIG. 7, the hose 242 includes a hose actuator port 283, which is a fluid flow path in the hose that is configured to align with the actuator port 284 for the purpose of transmitting fluid to the actuator port 284. In an embodiment in which the synchronized actuation member 244 is a hydraulic piston or includes a hydraulic piston, the synchronized actuator member 244 may also include a spring 286 to assist the piston to return to its original, position when no fluid is provided to the piston. The actuator 244 may include a switch or sensor to indicate the current state of the valves 254, 256 to indicate whether each valve is open, closed, or in an intermediate position.

The hose actuator port 283 may be configured to align with the actuator port 284 using any suitable method. For example, the threaded surfaces 288, 290 may be sized or "timed" so that when the threaded surfaces 288, 290 are fully engaged, the actuator port 284 and hose actuator port 283 are aligned. A switch or sensor may also be included to indicate whether the ports 283, 284 are aligned. In another embodiment, the hose 242 may include a keyed nozzle 282 that is received by a slot 281 in the lateral port. In such an embodiment, the second threaded surface 290 may be a part of a compression fitting that rotates relative to the body of the hose 242 to draw the hose 242 to seal against the lateral port 252.

In an embodiment, the subassembly 222 may also include a first fluid coupling sensor 280 and second fluid coupling sensor 268. The first fluid coupling sensor 280 may provide feedback, as described above, to indicate that a fluid coupling has been formed between the lateral port 252 and the hose 242 or a plug. Similarly, the second fluid coupling sensor 268 may provide feedback to indicate whether a drill string element or plug is coupled to the inlet 260.

In another embodiment, a hose and subassembly may have the attributes discussed above with regard to FIGS. 5-7, and a single valve may be coupled to an actuator instead of the two valves 254, 256 described above. In such an embodiment, the single valve may regulate flow through the lateral port and inlet, and may be actuated by an actuator member having an actuator port that is configured to align with a hose actuator port. Fluid may be delivered to the actuator member via the hose actuator port and actuator port to open and close the single valve, which may be a T-valve, flapper valve, or any other suitable valve.

Figure 8:
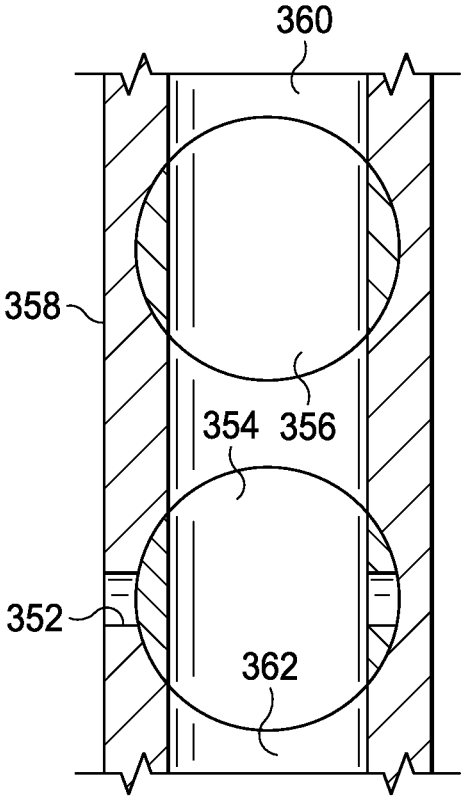
FIG. 8 is a detail view showing an alternative embodiment of a subassembly configured to enable a portion of a drill string to receive fluid from a secondary fluid supply source, wherein a valve that regulates the flow of fluid through the lateral port is a T-valve.
Figure 9:
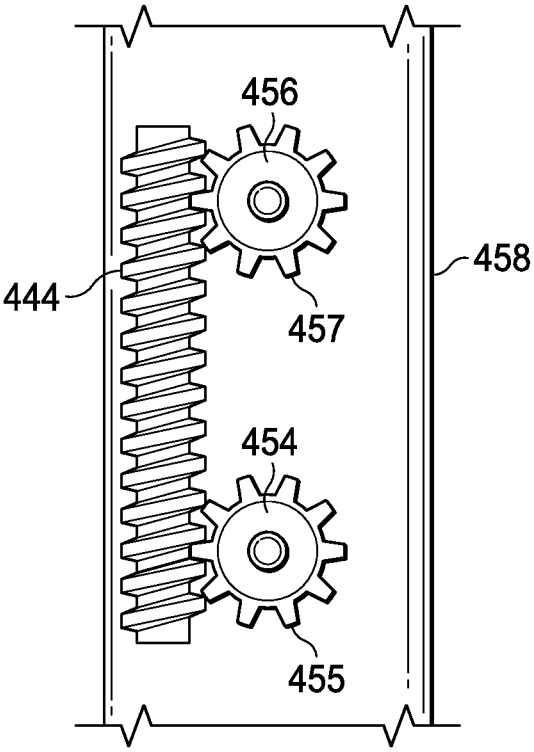
FIG. 9 is a detail view showing an alternative embodiment of a subassembly configured to enable a portion of a drill string to receive fluid from a secondary fluid supply source, wherein the valve that regulates the flow of fluid through the lateral port and a valve that regulates the flow of fluid through the inlet of the subassembly are synchronously actuated by a worm gear.

FIGS. 8 and 9 show alternative embodiments of a subassembly configured to enable a portion of a drill string to receive fluid from a secondary fluid supply source. As shown in FIG. 6, in an embodiment, each of the inlet valve 356 and lateral valve 354 may be quarter-turn valves that are synchronously actuated to enable the subassembly to receive flow from a secondary fluid supply source via the lateral port 352. As described herein, the valves 354, 356 may be actuated by any number of mechanisms, including flow or increased pressure at the lateral port, by operator-initiated mechanical controls coupled to at least one of the inlet valve 356 and lateral valve 354, or by remote operator-initiated controls, which may be electronic controls accessed from a remote user interface.

As shown in FIG. 9, in an embodiment, a lateral valve 454 and inlet valve 456 may be coupled to mechanical gears 455 and 457 that are synchronized by a mechanical linkage 444 or other mechanical actuator such that a quarter turn of the lateral valve 454 results in a quarter-turn of the inlet valve 456. In another embodiment, a lateral valve and inlet valve may be coupled to other drive mechanisms that facilitate synchronized operation, including any of the types of actuators described above. Such an embodiment may include a side port aligned the axis of rotation of the lateral valve 454 or inlet valve 456 to provide a path for a hex key, handle, or other suitable key or device for directly engaging and turning a valve. In such an embodiment, the a synchronous actuation member 444 relates the motion of the valves 454, 456 such that opening one of the valves 454 causes the other valve to open, and vise versa. The side port may provide access to an interface for a handle or hex-key, and the interface may be coupled to the lateral valve 454 or inlet valve 456 such that rotation of the interface results in rotation of the lateral valve 454 and inlet valve 456.

In an embodiment, the system may further include a portable computing device communicatively coupled to the controller to serve as a user interface device for an operator of the well and to provide an operator with notifications related to the supply of fluid to the drill string and, more particularly, the subassemblies 122 described above.

Figure 10A:
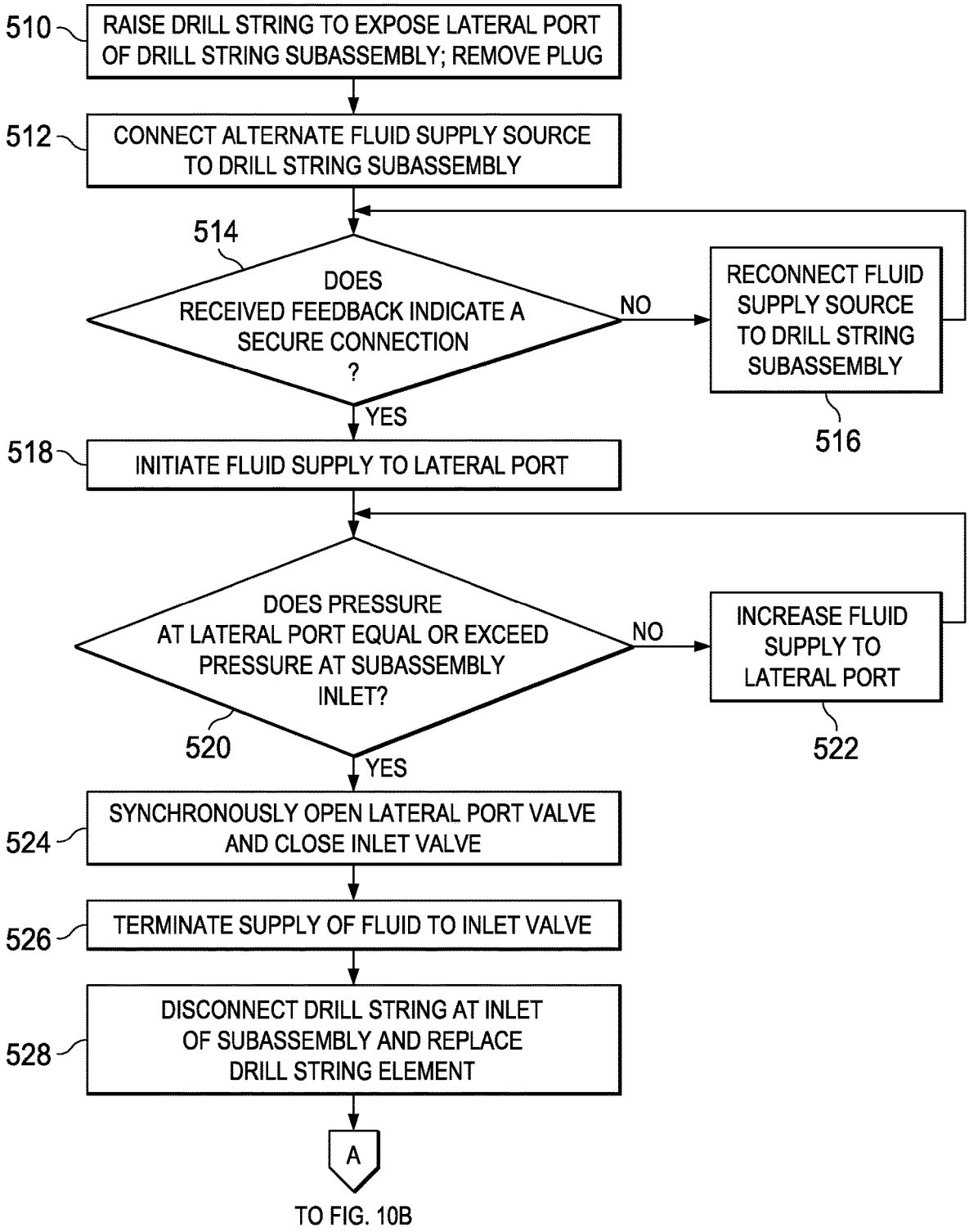
FIGS. 10A and 10B are flow charts showing an illustrative process for adding, removing, or changing a drill string element upstream of a subassembly having a port for receiving fluid from a secondary fluid supply source without interrupting flow to downhole elements of the drill string.
Figure 10B:
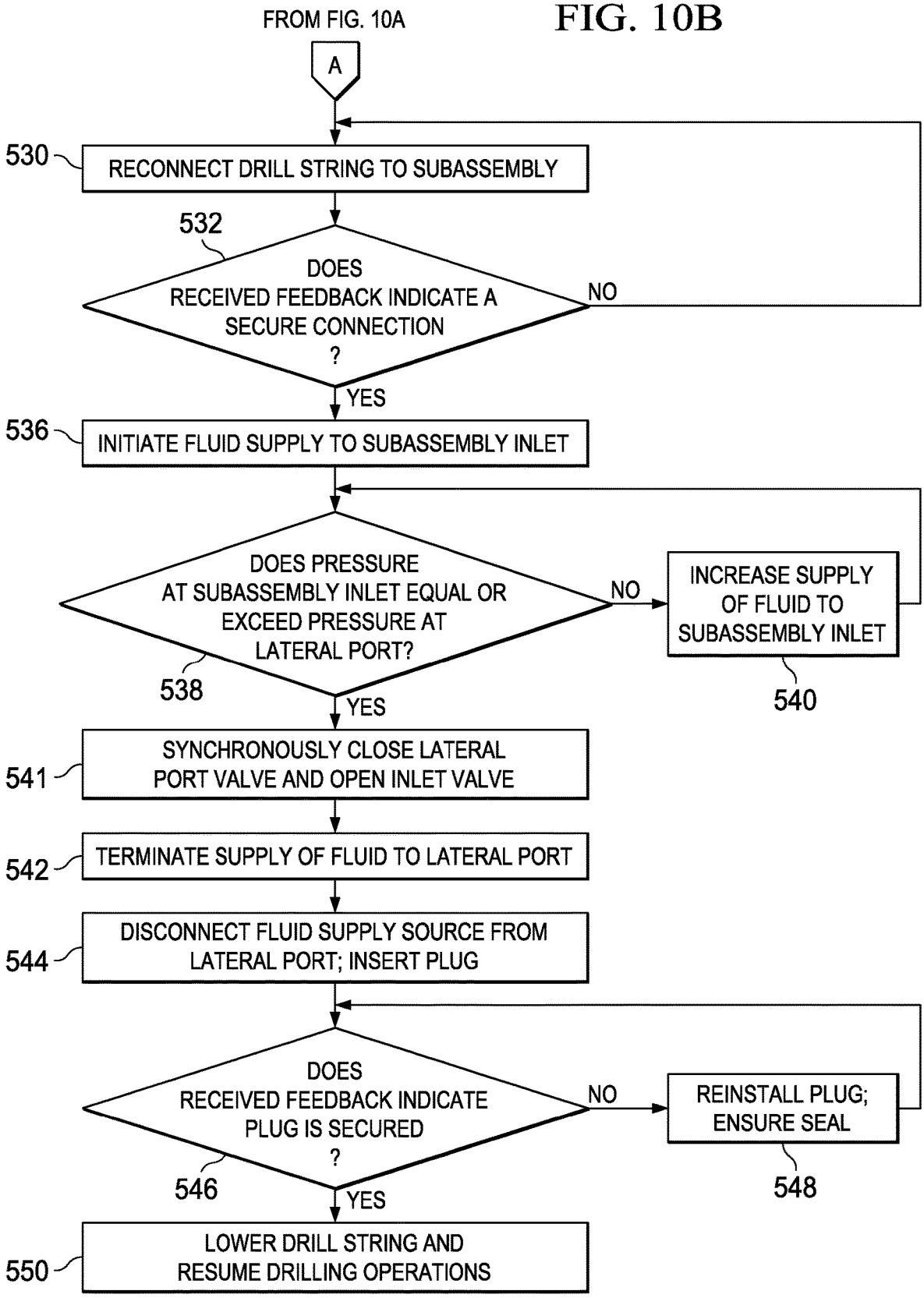

Turning now to FIGS. 10A and 10B, an illustrative process is shown for maintaining the circulation of fluid within a drill string and wellbore whilst adding an element or removing an element from a drill string 120 that includes the subassemblies 122 and an associated controller or control system, as described above with regard to FIGS. 1 and 2. The process includes raising the drill string to expose a lateral port and a drill string subassembly and removing a plug from the lateral port 510. Next, the operator connects a secondary fluid supply source to the subassembly at the lateral port 512. A fluid coupling sensor in the lateral port may provide feedback to the operator to indicate that a secure, sealed connection has been formed between the secondary fluid supply source and the lateral port. The feedback may be haptic (touch) feedback, auditory, or visual, and may therefore be in the form of a vibration, an audible sound, or a visual indicator, such as an LED in the hose 142 or subassembly 122. The feedback may be provided at the drill string or at a remote location, such as the surface controller or a personal computing device of an operator or technician, and the feedback may be selected based on the environment in which the operator is expected to receive the feedback. For example, if an operator is expected to receive the feedback at the rig floor, the feedback may be a visual indicator provided to a laptop computer or other personal computing device of the operator because the operator would be less likely to perceive an audible sound or vibration in a noisy, vibratory environment.

In an embodiment, the fluid coupling sensor may also provide feedback to a controller that is remote from the subassembly, such as the surface controller, and feedback notification indicating whether a secure, sealed connection has been formed may be provided at a remote user interface or control system, or to a personal computing device of an operator. By incorporating such fluid coupling sensors, an operator may ensure that, in a drill string having a plurality of subassemblies 122, only the valves of the topmost subassembly open and close when a secondary fluid supply source is provided and that the valves of downhole subassemblies are not actuated even a control signal is provided to such downhole subassemblies. In an embodiment, the process includes determining whether the received feedback indicates that a secure, fluidly sealed connection to the lateral port has been formed 514. If a secure connection has not been made, the operator reconnects the secondary fluid supply source to the lateral port of the drill string subassembly 516. If the feedback indicates that a secure connection has been made, the operator may initiate supply of fluid to the lateral port 518 from the secondary fluid supply source via the secure connection.

In an embodiment, the process may include determining whether the fluid pressure at the lateral port equals or exceeds the fluid pressure at a fluid inlet of the subassembly 520 using a flow sensor, pressure sensor, or sensors included in pumping equipment at the secondary fluid supply source and/or primary fluid supply source. If the fluid pressure at the lateral port does not equal or exceed the fluid pressure at the subassembly inlet, the operator increases fluid supply to the lateral port 522 via the secondary fluid supply source. Upon determining that the fluid pressure at the lateral port equals or exceeds the fluid pressure at the subassembly inlet, the process includes synchronously opening a valve at the lateral port and closing an inlet valve 524 to terminate the incoming flow of fluid received from a primary fluid supply source. In an embodiment, the process includes terminating the supply of fluid to the inlet valve from the primary fluid supply source 526. At this stage, drill string elements upstream, or up-string, from the subassembly may have passive flow characteristics, and may be added to or removed from the drill string without interrupting flow to the downhole portion of the drill string, which is now provided via the secondary fluid supply source. As such, the operator may disconnect the drill string at or before the inlet of the subassembly and replace an upstream drill string element 528.

After adding, removing, or replacing the drill string element, the operator may continue the process to return the drill string to its normal operating state. As such, the operator reconnects the drill string to the inlet of the subassembly 530. A second feedback mechanism may be included at the inlet of the subassembly to indicate whether a secure connection has been made between the subassembly and the drill string. Where such a feedback mechanism is included, the process includes making a determination as to whether a secure, fluidly sealed connection has been made between the drill string and the inlet of the subassembly 532. If a secure connection has not been made, a notification is generated, as described above with regard to the feedback sensor associated with the lateral port, and the operator again reconnects the drill string to the subassembly until the feedback sensor indicates a secure, sealed connection. When the feedback sensor indicates that a secure connection has been made, the operator may reinitiate the supply of fluid to the subassembly via the drill string 536 from the primary fluid supply source.

In an embodiment, after initiating the supply of fluid to the drill string from the primary fluid supply source, sensors in the subassembly determine if fluid pressure at the subassembly inlet is equal to or greater than the fluid pressure at the lateral port 538. The operator may increase the supply of fluid to the subassembly 540 until the system makes a determination that the pressure at the subassembly inlet is equal to or exceeds the fluid pressure at the lateral port. In another embodiment, the operator or an automated control system may monitor a flow sensor that is positioned to measure flow through the lateral port, and the inlet valve and lateral valve may be temporarily free to operate in either an open or closed state, or a half-open state, as dictated by the flow of fluid through the valves. In such an embodiment, the operator or control system may monitor the flow and send a command to the synchronous actuation member to close the lateral valve and open the inlet valve 541 in response to, for example, receiving a signal from the flow sensor indicating that flow into the lateral port is below a predetermined threshold that is sufficiently lower than the flow through the inlet valve.

Upon making such a determination, the operator may terminate the supply of fluid to the lateral port 542 via the secondary fluid supply source. At this point, the operator may disconnect the secondary fluid supply source from the lateral port and reinsert the plug 544. Again, feedback may be provided to indicate that the plug has been installed correctly and that the lateral port has been sealed. The process may therefore include making a determination as to whether received feedback indicates that the plug is secure 546 and that the lateral port is indeed sealed. If the feedback does not indicate that the plug is secure, the operator reinstalls the plug and ensures that the lateral port is sealed 548. Once the plug is sealed and positive feedback has been received, the drill string may be returned to its normal operating state and lowered back into the wellbore to resume drilling operations 550.

The illustrative systems, methods, and devices described herein may also be described by the following examples:

Example 1

A drill string subassembly for providing fluid to a wellbore, the subassembly comprising:

- a conduit having an inlet and an outlet and defining a flow path from the inlet to the outlet, the conduit also having a lateral port to the flow path between the inlet and the outlet;
- a first valve configured to control flow through the conduit via the lateral port;
- a second valve configured to control flow through the conduit from the inlet;
- a fluid coupling sensor for generating a fluid coupling signal in response the existence of a fluid coupling between a fluid source and the lateral port;
- a synchronous actuation member coupled to the first valve and second valve, and in communication with the fluid coupling sensor, the synchronous actuation member configured to open the first valve and close the second valve in response to the fluid coupling signal.

Example 2

The drill string subassembly of example 1, further comprising a flow sensor coupled to the lateral port, wherein the flow sensor generates a flow signal in response to detecting fluid flow into the lateral port.

Example 3

The drill string subassembly of example 2, wherein the synchronous actuation member is communicatively coupled to the flow sensor, and wherein the synchronous actuation member is operable to close the first valve and open the second valve in response to receiving a signal from the flow sensor indicating that flow into the lateral port is below a predetermined threshold.

Example 4

The drill string subassembly of examples 1, further comprising a pressure sensor, wherein the pressure sensor generates a pressure signal indicative of the pressure of the fluid in lateral port.

Example 5

The drill string subassembly of examples 1, further comprising a second pressure sensor, wherein the second pressure sensor generates a second pressure signal indicative of the pressure of the fluid in the conduit proximate the second valve.

Example 6

The drill string subassembly of example 5, wherein the synchronous actuation member is communicatively coupled to the first pressure sensor and second pressure sensor, and wherein the synchronous actuation member is operable to open the first valve and close the second valve in response to the first pressure signal and second pressure signal when the pressure of the fluid in the conduit proximate the second valve is less than the pressure of the fluid in the lateral port.

Example 7

The drill string subassembly of example 6, wherein the synchronous actuation member is operable to close the first valve and open the second valve in response to the first pressure signal and second pressure signal when the pressure of the fluid in the conduit proximate the second valve is greater than the pressure of the fluid in the lateral port.

Example 8

The drill string subassembly of example 1, wherein the synchronous actuation member comprises a controller, and one or more solenoids that actuate the first valve and second valve.

Example 9

The drill string subassembly of example 8, wherein the one or more solenoids are operable to open and close the first valve and second valve, respectively upon receiving an electronic signal.

Example 10

The drill string subassembly of example 1, wherein the synchronous actuation member comprises a series of gears.

Example 11

The drill string subassembly of example 1, wherein the synchronous actuation member comprises a mechanical actuator.

Example 12

The drill string subassembly of example 1, wherein the synchronous actuation member comprises a cable.

Example 13

The drill string subassembly of example 1, wherein the synchronous actuation member comprises a chain.

Example 14

The drill string subassembly of example 1, wherein the synchronous actuation member comprises one or more hydraulic or pneumatic solenoids, and wherein the one or more solenoids are actuated by a pressure pulse.

Example 15

A method for continuously circulating fluid in a wellbore, the method comprising:

installing drill string subassembly comprising a conduit having an inlet and an outlet and defining a flow path between the inlet and the outlet, and a lateral port to the flow path between the inlet and the outlet; a first valve configured for controlling flow through the conduit from the lateral port; a second valve configured for controlling flow through the conduit from the inlet; a fluid coupling sensor coupled to the lateral port to generate a fluid coupling signal responsive to coupling of a fluid supply source to the lateral port; and a synchronous actuation member coupled to the first valve and second valve and operable to cause the first valve to open and the second valve close to close in response to the fluid coupling signal;

coupling a fluid supply source to the lateral port;

receiving the fluid coupling signal; and supplying fluid to the drill string subassembly through the lateral port.

Example 16

The method of example 15, further comprising disconnecting an element of the drill string that is above the drill string subassembly without interrupting the flow of fluid through the drill string.

Example 17

The method of examples 15 or 16, wherein the fluid coupling signal comprises an auditory signal.

Example 18

The method of examples 15-17, wherein the fluid coupling signal comprises haptic feedback.

Example 19

The method of examples 15-18, wherein the fluid coupling signal comprises a visual signal.

Example 20

The method of examples 15-19, wherein the fluid coupling signal comprises an electronic signal that is displayed on a graphical display of a computing device.

Example 21

The method of examples 15-20, further comprising coupling the drill string subassembly to a control system, wherein the control system is communicatively coupled to a computing device of a user.

Example 22

The method of examples 15-21, wherein the synchronous actuation member comprises a controller and one or more solenoids that actuate the lateral valve and inlet valve.

Example 23

The method of example 22, wherein the one or more solenoids are operable to open and close the first valve and second valve, respectively upon receiving an electronic signal.

Example 24

The method of examples 15-21, wherein the synchronous actuation member comprises a worm gear actuator.

Example 25

The method of examples 15-21, wherein the synchronous actuation member is selected from the group consisting of a mechanical linkage, a single or dual electronic actuator, a traveling nut actuator, a cylinder actuator, or an electric motor actuator.

Example 26

The method of examples 15-21, wherein the synchronous actuation member is comprises one or more hydraulic or pneumatic solenoids, and wherein the solenoids are actuated by a pressure pulse.

Example 27

A system for continuously circulating fluid in a wellbore, the system comprising:

- a control system comprising a memory, a power source, and a user interface;
- a drill string subassembly comprising:
  - a conduit having an inlet and an outlet and defining a flow path from the inlet to the outlet, and having a lateral port to the fluid flow path between the inlet and the outlet;
  - a first valve for controlling flow through the conduit from the lateral port;
  - a second valve for controlling flow through the conduit from the inlet;
  - a fluid coupling sensor configured to generate a fluid coupling signal responsive to coupling of a secondary fluid source to the lateral port;
  - a synchronous actuation member coupled to the first valve and second valve and operable to cause the first valve to open and the second valve to close in response to the signal from the sensor; and
- a primary fluid supply source releasably coupled to the inlet, wherein the control system is communicatively coupled to the fluid coupling sensor and the synchronous actuation member.

Example 28

The system of examples 27, further comprising a portable computing device, wherein the control system is communicatively coupled to the portable computing device and the portable computing device is operable to generate a visual, audible, or haptic signal in response to the control system receiving the fluid coupling signal.

Example 29

The system of examples 27 or 28, wherein the drill string subassembly includes a flow sensor communicatively coupled to the control system and configured to generate a flow signal indicative of a rate of fluid flow into the lateral port.

Example 30

The system of examples 27-29, wherein the control system is communicatively coupled to the flow sensor and operable to receive the flow signal, and wherein the control system is operable to determine whether the flow in the lateral port is less than a predetermined threshold and to activate the synchronous actuation member to close the first valve and open the second valve in response to determining that the flow in the lateral port is less than the predetermined threshold.

Example 31

The system of examples 27-29, wherein the drill string subassembly includes:

- a first pressure sensor communicatively coupled to the control system and configured to generate a first pressure signal indicative of the pressure of the fluid in lateral port; and
- a second pressure sensor communicatively coupled to the control system configured to generate a second pressure signal indicative of the pressure of the fluid in at or near the inlet of the conduit.

Example 32

The system of example 31, wherein the control system is configured to receive the first pressure signal and the second pressure signal, and to determine whether the pressure of the fluid in the conduit at or near the inlet of the conduit is less than the pressure of the fluid in the lateral port; and wherein the control system is operable to generate a command to the synchronous actuation member to open the first valve and close the second valve in response to determining that the pressure of the fluid at or near the inlet of the conduit is less than the pressure of the fluid in the lateral port.

Example 33

The system of examples 27-32, wherein the synchronous actuation member comprises coupled to a controller, a first solenoid that actuates the first valve, and a second solenoid that actuates the second valve.

Example 34

The system of example 33, wherein the first solenoid and second solenoid are operable to open and close the first valve and second valve, respectively upon receiving an electronic signal.

Example 35

The system of examples 27-32, wherein the synchronous actuation member comprises a worm gear.

Example 36

The system of examples 27-32, wherein the synchronous actuation member comprises a mechanical linkage.

Example 37

The system of examples 27-32, wherein the synchronous actuation member comprises a cable in tension.

Example 38

The system of examples 27-32, wherein the synchronous actuation member comprises a plurality of hydraulic or pneumatic solenoids, and wherein the solenoids are actuated by a pressure pulse.

Example 39

The system of example 27, wherein the synchronous actuator member comprises an actuator port defining a fluid flow path to the synchronous actuator member and wherein the hose comprises a hose actuator port defining a fluid flow path from the hose to the actuator port, and wherein the synchronous actuator is configured to actuate the first valve and second valve in response to a fluid being transmitted from the hose actuator port to the actuator port.

Example 40

The system of example 39, wherein:

the hose comprises a nozzle forming a key;

the lateral port comprises a slot for accepting the key; and engagement of the key and slot causes the hose actuator port to align with the actuator port.

Example 41

The system of example 39, wherein:

the lateral port comprises a first threaded surface;

the hose comprises a second threaded surface that is sized and configured to engage the first threaded surface, and the actuator port and hose actuator port are configured to align when the second threaded surface of the hose engages the first threaded surface of the lateral port.

Example 42

The system of example 41, wherein the synchronous actuation member comprises a hydraulic actuator that actuates the first valve and second valve in response to receiving fluid via the actuator port.

Example 43

A system for continuously circulating fluid in a wellbore, the system comprising:

a control system comprising a memory, a power source, and a user interface;

a drill string subassembly comprising:

a conduit having an inlet and an outlet and defining a flow path from the inlet to the outlet, and having a lateral port to the fluid flow path between the inlet and the outlet;

a valve for controlling flow through the conduit from the lateral port and through the conduit from the inlet;

an actuation member coupled to the first valve and operable to cause the valve to open and close; and a primary fluid supply source releasably coupled to the inlet and a secondary fluid supply source releasably coupled to the lateral port via a hose, wherein the actuator member comprises an actuator port defining a fluid flow path to the actuator member and wherein the hose comprises a hose actuator port defining a fluid flow path from the hose to the actuator port, and wherein the actuator member is configured to actuate the valve in response to a fluid being transmitted from the hose actuator port to the actuator port.

It should be apparent from the foregoing that an invention having significant advantages has been provided. While the invention is shown in only a few of its forms, it is not limited to only these embodiments but is susceptible to various changes and modifications without departing from the spirit thereof.

I claim:

1. An apparatus for controlling fluid flow to a wellbore, the apparatus comprising:

a conduit having an inlet and an outlet and defining a flow path from the inlet to the outlet, the conduit including a lateral port to the flow path between the inlet and the outlet;

a first valve configured for controlling flow to the conduit from the lateral port of the conduit;

a second valve configured for controlling flow through the inlet of the conduit; and a synchronous actuation member comprising one or more solenoids and a controller coupled to the first and second valves, the synchronous actuation member configured to synchronize the operation of the first valve and second valve, wherein:

one of the one or more solenoids, when activated by the controller, actuates the first valve to extend into the conduit;

the synchronous actuation member is operable to cause the first valve to close as the second valve opens and cause the first valve to open as the second valve closes.

2. The apparatus of claim 1, wherein the conduit further comprises a side port aligned with an axis of rotation of one of the first valve and second valve, and wherein one of the first valve and second valve includes an interface for a handle or hex-key, and wherein the interface is coupled to the first or second valve such that rotation of the interface results in rotation of the first valve and second valve.

3. The apparatus of claim 1, wherein another one of the one or more solenoids, when activated by the controller, actuates the second valve.

4. The apparatus of claim 1, wherein the first valve and second valve are actuated by a pressure pulse.

5. The apparatus of claim 1, further comprising a fluid coupling sensor configured to generate a signal responsive to coupling of a fluid source to the lateral port, wherein the synchronous actuation member is configured to close the second valve in response to the signal from the fluid coupling sensor.

6. The apparatus of claim 1, further comprising a flow sensor operable to generate a flow signal indicative of a rate of fluid flow through the lateral port, wherein the synchronous actuation member closes the first valve and opens the second valve in response to the rate of fluid flow through the lateral port being below a predetermined threshold.

7. The apparatus of claim 1, further comprising a pressure sensor operable to generate a pressure signal that is indicative of the fluid pressure at the lateral port, wherein the synchronous actuation member opens the first valve and closes the second valve in response to the fluid pressure at the lateral port being greater than a predeteiiiiined threshold.

8. The apparatus of claim 1, further comprising:

a pressure sensor operable to generate a fluid pressure signal that is indicative of the fluid pressure at the lateral port; and a second pressure sensor operable to generate a second fluid pressure signal that is indicative of the fluid pressure at the inlet, wherein the synchronous actuation member is operable to open the first valve and close the second valve in response to the fluid pressure at the lateral port being greater than the fluid pressure at the inlet.

9. A system for continuously circulating fluid in a wellbore, the system comprising:

a conduit having an inlet and an outlet and defining a flow path between the inlet and the outlet, the conduit including a lateral port to the flow path between the inlet and the outlet;

a first valve configured for controlling flow to the conduit from the lateral port;

a second valve configured for controlling flow through the inlet;

a synchronous actuation member comprising one or more solenoids and a controller coupled to the first and second valves, the synchronous actuation member configured to synchronize the operation of the first and second valve, wherein:

one of the one or more solenoids, when activated by the controller, actuates the first valve to extend into the conduit; and the synchronous actuation member is operable to cause the first valve to close as the second valve opens and cause the first valve to open as the second valve closes;

a secondary fluid supply source; and a hose for delivering fluid from the secondary fluid supply source, wherein the hose is configured to engage the lateral port to deliver fluid to the conduit from the secondary fluid supply source.

10. The system of claim 9, wherein another one of the one or more solenoids, when activated by the controller, actuates the second valve.

11. The system of claim 9, wherein the synchronous actuation member comprises a hydraulic or electrical control line coupled to the synchronous actuation member.

12. The system of claim 11, wherein the synchronous actuator member comprises an actuator port defining a fluid flow path to the synchronous actuator member and wherein the hose comprises a hose actuator port defining a fluid flow path from the hose to the actuator port, and wherein the synchronous actuator is configured to actuate the first valve and second valve in response to a fluid being transmitted from the hose actuator port to the actuator port.

13. The system of claim 9, further comprising:

a fluid coupling sensor configured to generate a signal responsive to coupling of a fluid supply source to the lateral port; and a portable computing device communicatively coupled to the control system and operable to generate a visual, auditory, electronic, or haptic signal to an operator in response to the control system receiving the signal from the fluid coupling sensor.

14. The system of claim 9, wherein the conduit includes a fluid coupling sensor communicatively coupled to the control system and configured to generate a fluid coupling signal responsive to coupling of a fluid supply source to the lateral port;

a first pressure sensor communicatively coupled to the control system and operable to generate a first pressure signal indicative of a fluid pressure in the lateral port; and a second pressure sensor communicatively coupled to the control system and operable to generate a second pressure signal indicative of a fluid pressure at the inlet, wherein the synchronous actuation member is operable to open the first valve and close the second valve in response to the control system receiving the fluid coupling signal and determining, based on the first pressure signal and second pressure signal, that the fluid pressure in the lateral port is greater than the fluid pressure at the inlet.

* * * * *